US007329108B2

(12) United States Patent
Tsuchiya et al.

(10) Patent No.: US 7,329,108 B2
(45) Date of Patent: Feb. 12, 2008

(54) SCROLL FLUID MACHINE

(75) Inventors: Masaru Tsuchiya, Yokohama (JP); Hidetoshi Ishikawa, Ebina (JP); Youhei Midorikawa, Tokyo (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/536,202

(22) Filed: Sep. 28, 2006

(65) Prior Publication Data

US 2007/0077159 A1 Apr. 5, 2007

(30) Foreign Application Priority Data

Sep. 30, 2005 (JP) ..... 2005-287447

(51) Int. Cl.
*F01C 1/02* (2006.01)
*F04C 2/00* (2006.01)

(52) U.S. Cl. ..... 418/55.1; 418/15; 418/55.6; 418/85; 418/92; 418/101

(58) Field of Classification Search ..... 418/55.1–55.6, 418/101, 15, 85, 92
See application file for complete search history.

(56) References Cited

U.S. PATENT DOCUMENTS 5,417,554 A * 5/1995 Kietzman et al. ..... 418/101
6,190,145 B1 * 2/2001 Fujioka et al. ..... 418/55.1
2004/0241030 A1 12/2004 Matsushima

FOREIGN PATENT DOCUMENTS

| | | | | |
|---|---|---|---|---|
| JP | 60209690 A | * | 10/1985 | ..... 418/101 |
| JP | 04342801 A | * | 11/1992 | ..... 418/101 |
| JP | 7-42953 | | 5/1995 | |
| JP | 09053589 A | * | 2/1997 | |
| JP | 10-26090 | | 1/1998 | |

* cited by examiner

*Primary Examiner*—Theresa Trieu
(74) *Attorney, Agent, or Firm*—Ostrolenk, Faber, Gerb & Soffen, LLP

(57) ABSTRACT

A scroll fluid machine comprises a housing having a fixed scroll and an orbiting scroll revolved by a driving shaft which is driven by a motor behind the housing. A blowing fan is provided between the orbiting scroll and the motor. Rotation of the fan causes decompression in the housing to allow primary external air to be sucked from the outside into the housing through a primary sucking hole. Secondary external air is introduced from a secondary sucking hole and mixed with the primary external air of the scroll fluid machine to cool the parts of the scroll fluid machine in the housing and/or the motor.

6 Claims, 6 Drawing Sheets

SCROLL FLUID MACHINE

BACKGROUND OF THE INVENTION

The present invention relates to a scroll fluid machine such as a scroll vacuum pump or a scroll compressor, and particularly to a scroll fluid machine comprising a fixed scroll having a fixed wrap in a housing and an orbiting scroll having an orbiting wrap, said orbiting scroll being eccentrically revolved with a driving shaft via an eccentric axial portion so that a gas sucked from the outer circumference or a center may be compressed or decompressed towards the center or outer circumference respectively.

Such a scroll fluid machine is well-known among persons skilled in the art as described in a number of references such as JP7-42953B2 and JP10-26090A.

In such a scroll fluid machine, long operation time raises the temperatures of an axial end portion of a driving shaft, a bearing or a packing that support it, end plates of wraps of fixed and orbiting scrolls, a tip seal that engages with the tip end of the wrap and a motor, causing excessive wear, deformation, damage and/or leaking of lubricating oil in a bearing to make it impossible for the scroll fluid machine to exhibit expected performance and durability.

In order to overcome the problems, in JP7-42953B2 and JP10-26090A, a single fan is mounted to a driving shaft and external air is introduced from the surroundings of a housing with operation thereby cooling an eccentric axial portion of the driving shaft, its bearing and other surrounding members automatically.

JP7-42953B2 discloses a scroll fluid machine in FIGS. 4-7 in which, as cooling fluid sucked from the sucking hole 6 at one end of the frame 4 during operation goes to the discharge hole 16 at the other end of the frame 4, the fluid is heated gradually with various elements in the frame 4. Elements in the rear of the frame such as bearings 8 and 11 cannot be sufficiently cooled compared with the front elements, which is basically disadvantageous. In the reference, the motor is provided outside the frame 4 and there are no measures for cooling it positively.

JP10-26090A discloses a scroll fluid machine in which as shown in FIG. 2, after the motor 11 in the guide ring 16 is cooled with the sucked cooling wind 18, the cooling wind 17 is guided to the bearing 6, scroll compression chamber 7 etc. behind the motor 11. Thus, the temperature of the cooling wind 17 introduced to the bearing 6 is already raised considerably making it difficult to cool the elements behind the motor 11.

In order to solve such disadvantages, US2004/0241030A1 is suggested. To the driving shaft 8 driven by the motor 17, the cooling fans 16,15 are mounted in front of and behind the engaging portion of the fixed and orbiting scrolls 4*c* and 5. With operation, external cooling air is sucked via the through holes of the front and rear ends of the housing 1 by the cooling fans 16, 15, introducing external air over the broad area in the housing 1.

Each part of the scroll fluid machine is uniformly cooled, but the two cooling fans increase the whole size, weight and cost. And consumed electricity is increased as well as noise from the cooling fans. In the US Patent publication, there are no measures for cooling the driving motor positively.

SUMMARY OF THE INVENTION

In view of the disadvantages in the prior art, it is an object of the invention to provide a scroll fluid machine allowing a motor and other parts to be cooled efficiently with circulating air through or around a housing.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENTS

Figure 1:
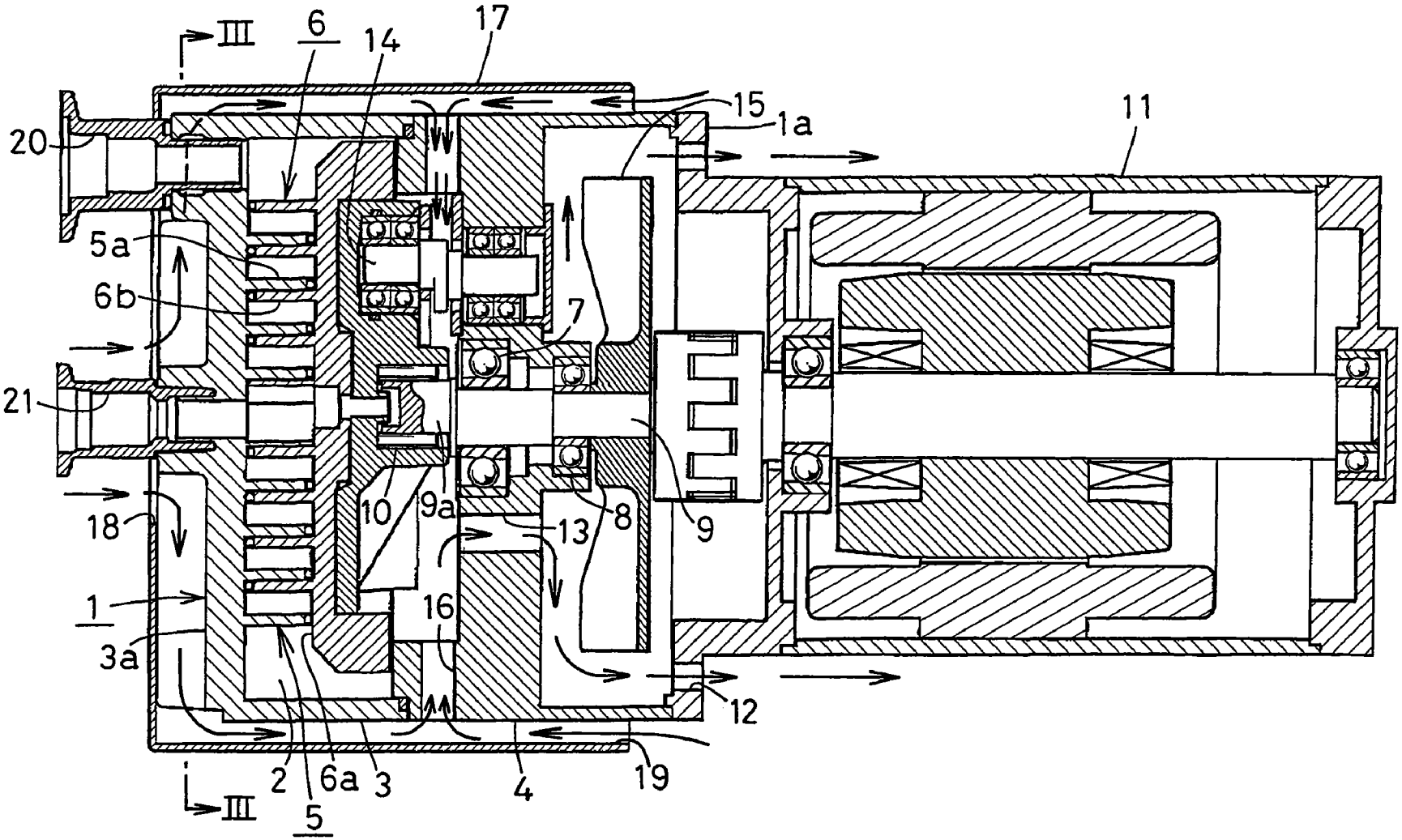
FIG. 1 is a vertical sectional front view of the first embodiment of a scroll fluid machine according to the present invention.
Figure 2:
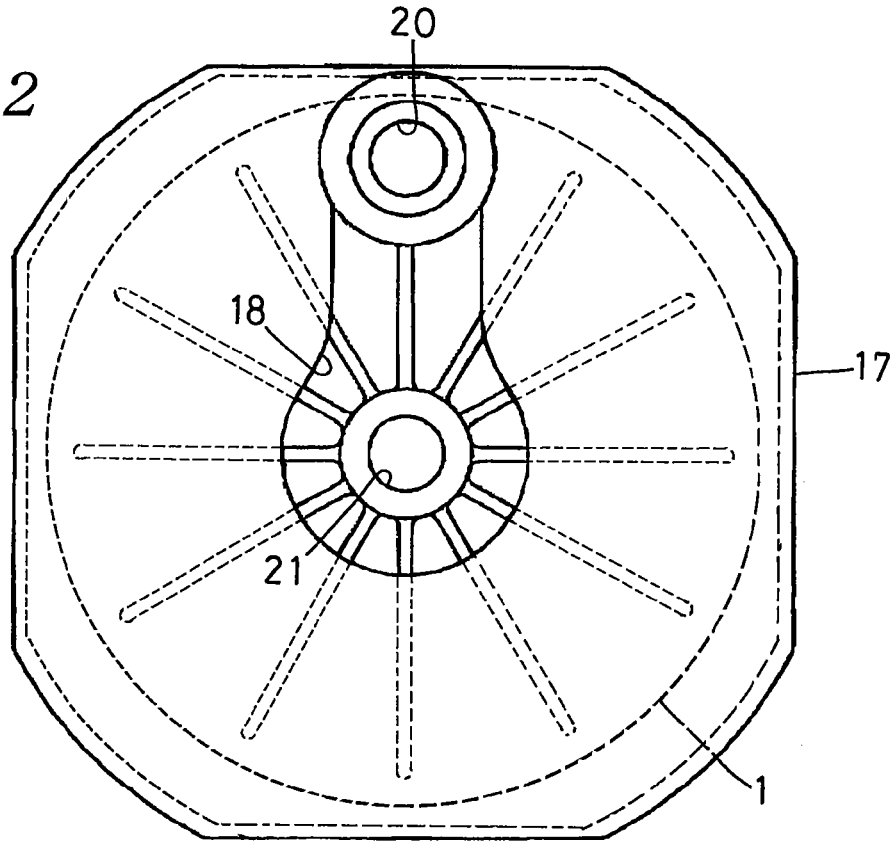
FIG. 2 is a left side elevational view of the scroll fluid machine in FIG. 1.
Figure 3:
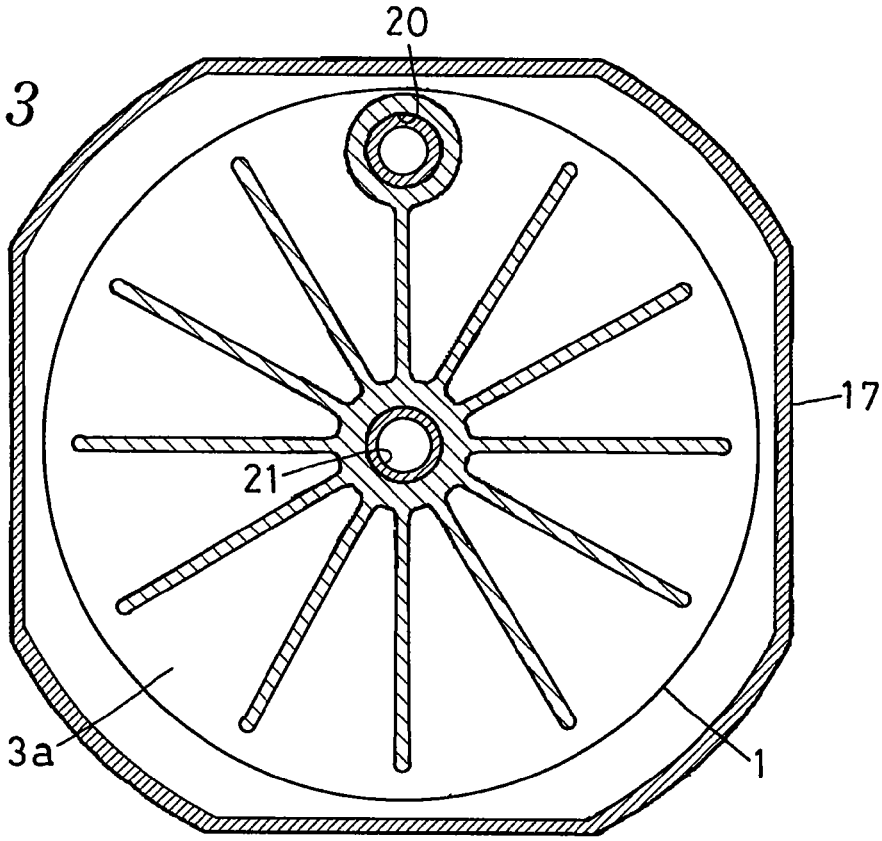
FIG. 3 is a vertical sectional view taken along the line Ill-Ill in FIG. 1.

The left and right sides in FIG. 1 are deemed the front and rear in the description below.

A housing 1 having a sealed compression chamber 2 comprises a casing 3 and a cover 4. An end plate 3*a* of the casing 3 also acts as a fixed end plate of a fixed scroll 5, and a fixed wrap 5*a* stands on the rear surface of the end plate 3*a*. The fixed scroll 5 faces an orbiting scroll 6.

The orbiting scroll 6 comprises an orbiting end plate 6*a* having an orbiting wrap 6*b* which engages with the fixed wrap 5*a* to form the compression chamber 2 between the fixed wrap 5*a* and the orbiting wrap 6*b*. The orbiting scroll 6 is pivotally secured via a needle bearing 10 to an eccentric axial portion 9*a* of a driving shaft 9 provided at the center of the cover 4 via bearings 7,8.

The driving shaft 9 is driven by a motor 11 behind the housing 1.

The motor 11 is cylindrical and its external diameter is smaller than an external diameter of a rear wall 1*a* of the housing 1. The rear wall 1*a* of the housing 1 has a discharge hole 12. An air hole 13 is formed through the cover 4.

The orbiting end plate 6*a* is connected to the cover 4 with three pin-crank-type self-rotation preventing mechanisms 14. With the rotation of the driving shaft 9, the orbiting end plate 6*a* is eccentrically revolved to change the radial distance of the space between the fixed wrap 5*a* and the orbiting wrap 6*b* engaging with each other.

Between the cover 4 and the rear wall 1*a* of the housing 1, a rearward blowing axial fan 15 is mounted to the driving shaft 9. Between the casing 3 and the cover 4, a radial air hole 16 communicates with the air hole 13 of the cover 4.

A covering tube 17 covers the front surface of the casing 3 and the outer circumference of the housing 1 comprising the casing 3 and cover 4 with a gap.

A primary sucking hole 18 is formed on the front surface of the covering tube 17 and a secondary annular sucking hole 19 is formed between the outer circumference of the housing 1 and the covering tube 17.

A suction hole 20 and a discharge hole 21 of the compression chamber 2 are formed on the outer circumference and the center respectively of the end plate 3*a* of the casing 3.

The orbiting scroll 6 is driven with the driving shaft 9 by the motor 11, so that the blowing fan 15 mounted to the driving shaft 9 generates backward air flow. Thus, the housing 1 is decompressed and external air is sucked through the primary sucking hole 18, and flows radially and rearward. After the engaging portion of the fixed and orbiting scrolls 5, 6 is cooled by air, air flows into the housing 1 from the air hole 16 to cool the eccentric axial portion 9*a* and bearing 7.

Then, air is discharged via the air hole 13 and discharge hole 12. With decompression in the housing 1, secondary external air is sucked via the secondary sucking hole 19 and air hole 16.

Primary external air forwarded from the front of the housing 1 and raised in temperature is mixed with secondary external air which is not heated, so that it is forwarded under low temperature into the housing 1 from the air hole 16.

Figure 4:
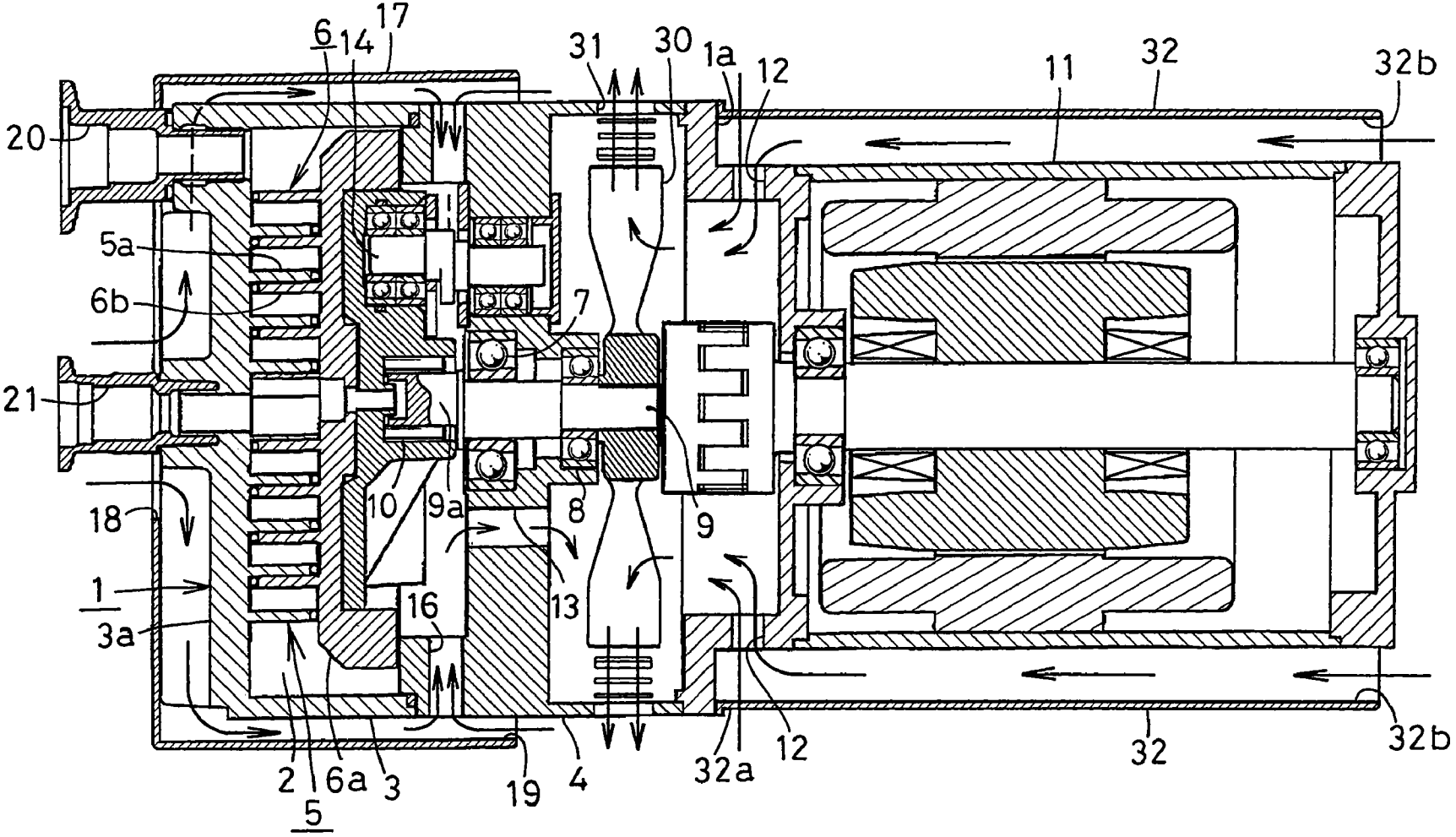
FIG. 4 is a vertical sectional front view of the second embodiment of the present invention.

FIG. 4 shows the second embodiment of a scroll fluid machine according to the present invention. The same numerals are assigned to the same members and description thereof is omitted. Only differences will be described. Instead of the axial fan in FIG. 1, a centrifugal fan 30 is provided and a discharge hole 31 is formed in a housing 1, facing the blowing fan 30.

A motor 11 is covered with an external tube 32 with a space and the front end of the external tube 32 is radially outer than a discharge hole 12 of a rear wall 1*a* of the housing 1. External air flows as shown by arrows. Primary external air is sucked via a primary external air inlet 18 and a rear end 32*b* of the external tube 32.

Figure 5:
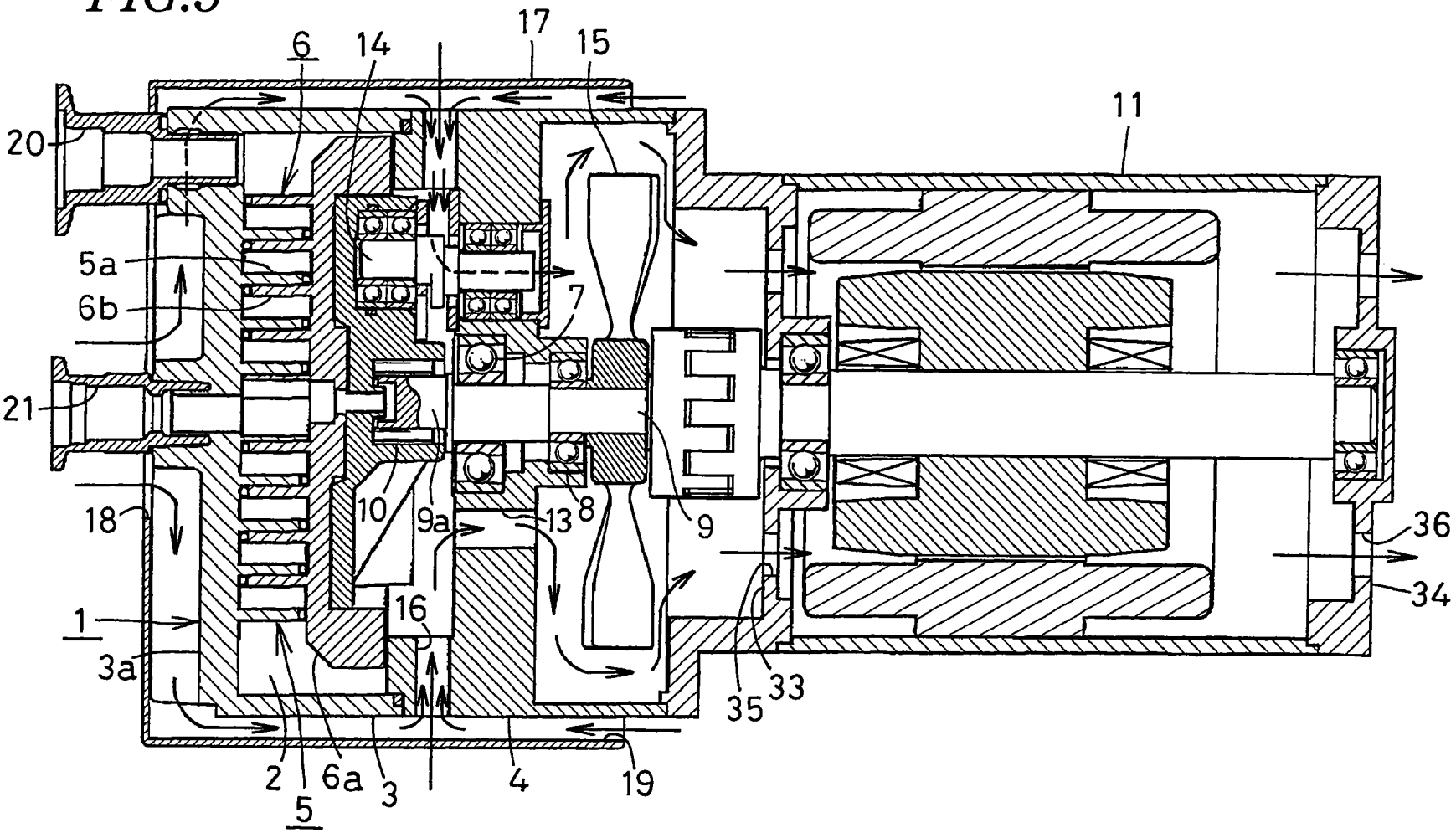
FIG. 5 is a vertical sectional front view of the third embodiment of the present invention.

FIG. 5 shows the third embodiment of the present invention. The same numerals are assigned to the same members and description thereof is omitted. Only difference will be described.

Without the discharge hole of the rear wall 1*a* of the housing 1 in FIG. 1, a communicating hole 35 and a discharge hole 36 are formed in a front wall 33 and a rear wall 34 of a motor 11 respectively.

Secondary external air mixed with primary external air by a blowing fan 15 is sucked into the housing 1, forwarded into the motor 11 via the communicating hole 35 and discharged from the discharge hole 36.

Primary and secondary external air sucked into the housing 1 is not directly discharged to the outside, but discharged from the discharge hole 36 after it flows in the motor 11 via the communicating hole 11 to cool the motor 11.

Figure 6:
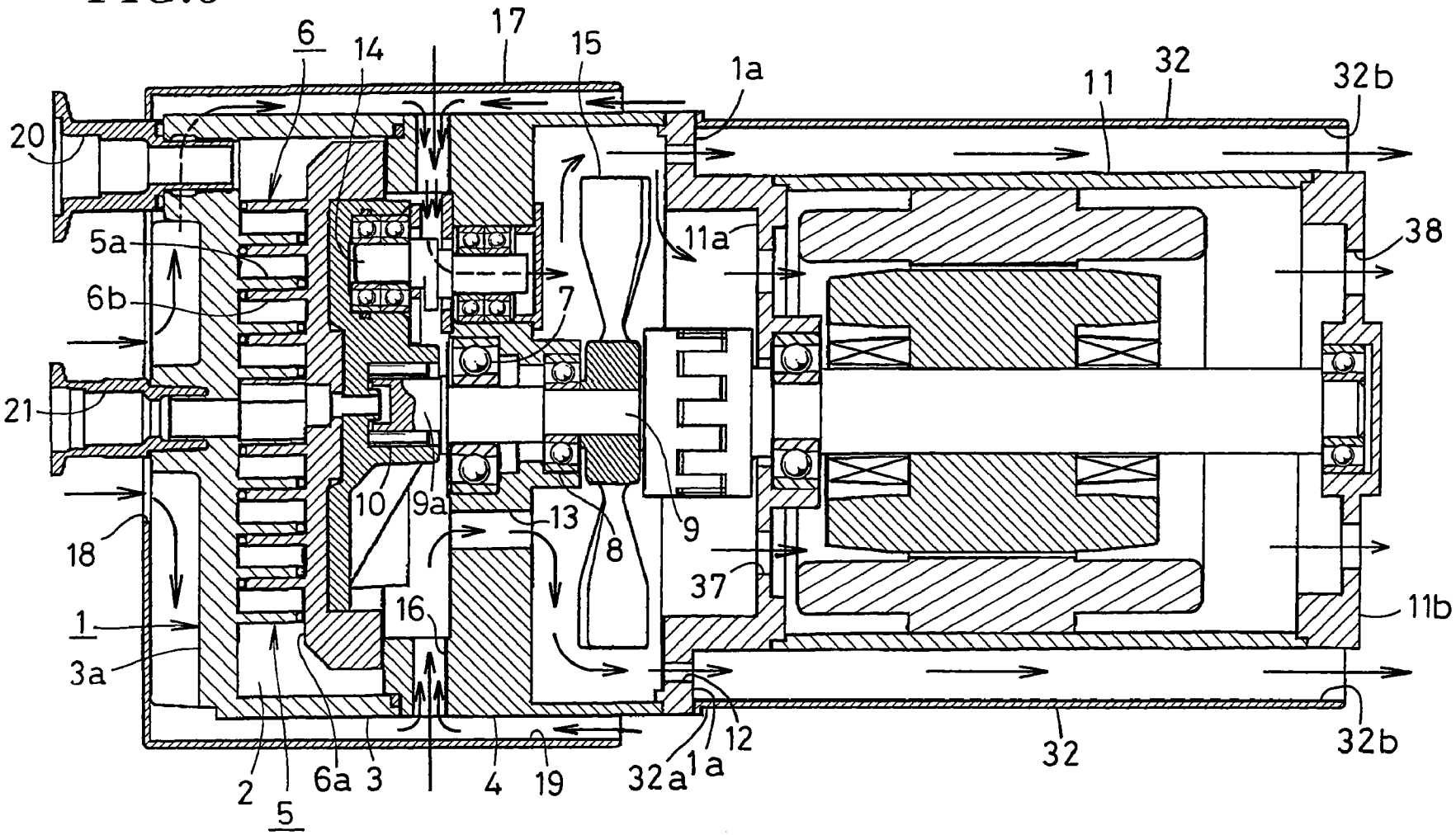
FIG. 6 is a vertical sectional front view of the fourth embodiment of the present invention.

FIG. 6 is the fourth embodiment of the present invention. The same numerals are assigned to the same members and only differences will be described.

A motor 11 is covered with an external tube 32 with a space. The front end of the external tube 32 is connected to a rear wall 1*a* of a housing 1 at a position radially outer than a discharge hole 12 and the rear end 32*b* of the external tube 32 is allowed to open. A front plate 11*a* and a rear plate 11*b* of the motor 11 have communicating holes 37 and 38 respectively. External air that flows therein is discharged via the inside and outside of the motor 11.

Figure 7:
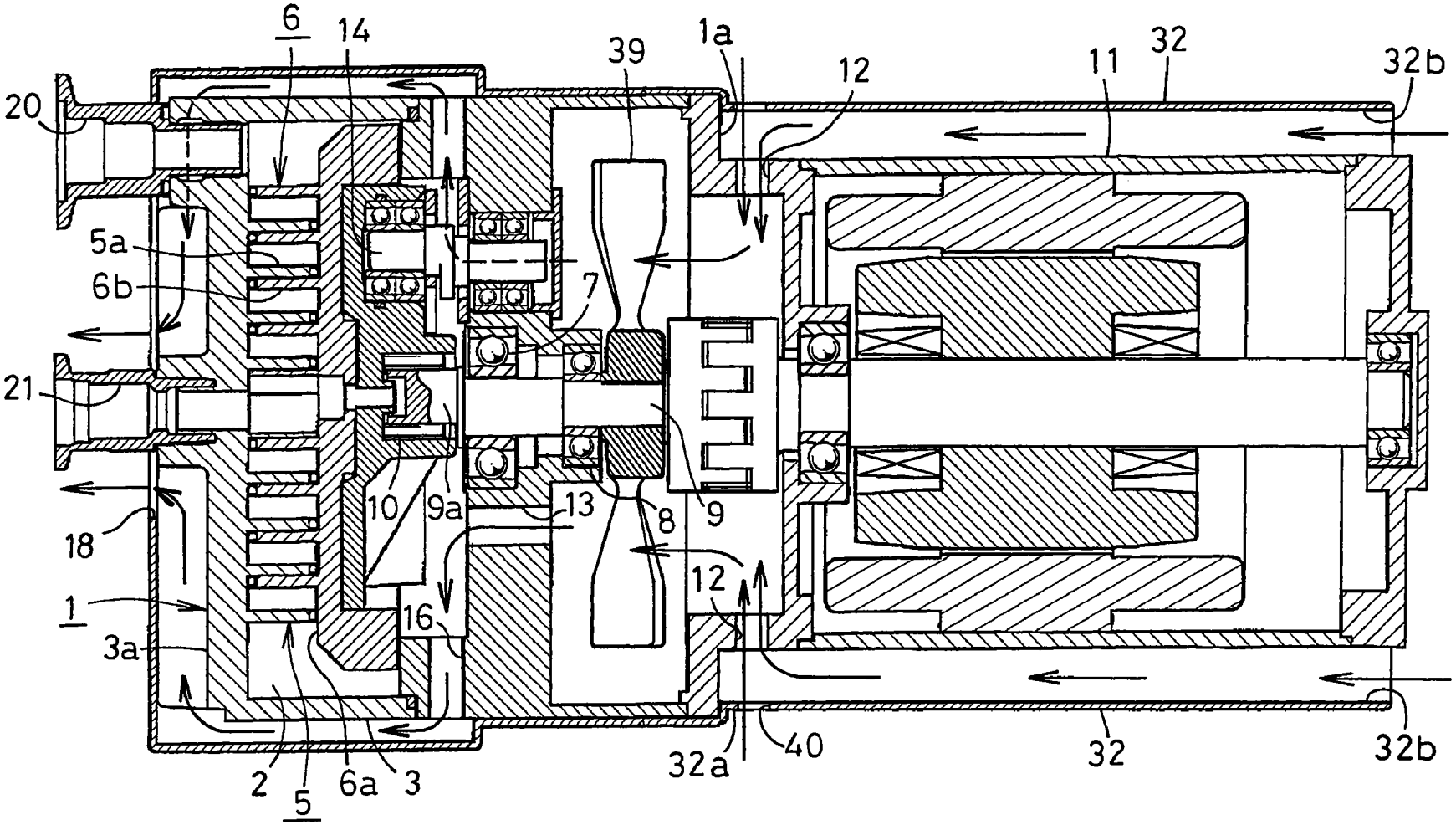
FIG. 7 is a vertical sectional front view of the fifth embodiment of the present invention.

FIG. 7 shows the fifth embodiment of the present invention. The same numerals are assigned to the same members and only differences will be described.

A blowing fan 39 allows air to flow forwards, and an external tube 32 is provided around a motor 11. A secondary external air sucking hole 40 is formed at the front end of the external tube 32. External air flows as shown by arrows.

The foregoing merely relate to embodiments of the invention. Various changes and modifications may be made by a person skilled in the art without departing from the scope of claims wherein:

What is claimed is:

1. A scroll fluid machine comprising:

a housing;

a motor behind the housing;

a driving shaft having an eccentric axial portion at one end and driven by the motor;

a fixed scroll fixed in the housing and having a fixed wrap;

an orbiting scroll having an orbiting wrap to form a sealed chamber between the fixed wrap and the orbiting wrap, said orbiting scroll being eccentrically revolved with the eccentric axial portion of the driving shaft so that the orbiting scroll is operable to compress a gas sucked in the sealed chamber from an outer circumference or a center of the housing towards the center and so that the orbiting scroll is operable to decompress and discharge the gas towards the outer circumference;

a covering tube covering the housing such that a space is created between the covering tube and the housing;

a blowing fan mounted to the driving shaft in the housing; and a primary sucking aperture opening to a primary passage formed in the space between a front face of the housing and the covering tube to communicate with the blowing fan, and a secondary sucking aperture opening to a secondary passage formed in the space between a rear part of the housing and the covering tube to communicate with the blowing fan and the primary passage, the primary passage being configured and positioned to introduce primary external air under decompression owing to rotation of the blowing fan, and the secondary passage being configured and positioned to introduce secondary external air under decompression owing to discharge of the primary external air to mix with the primary external air to cool the eccentric axial portion and parts of the driving shaft.

2. The scroll fluid machine according to claim 1, wherein the primary external air and the secondary external air are finally discharged to an outside.

3. The scroll fluid machine according to claim 1, wherein the blowing fan comprises an axial fan.

4. A scroll fluid machine according to claim 1 wherein the blowing fan comprises a centrifugal fan, the motor being covered with an outer tube with a space through which external air is also sucked from a back of the motor.

5. A scroll fluid machine according to claim 1 wherein air is finally discharged into the motor to cool the motor.

6. A scroll fluid machine according to claim 5, further comprising an outer tube around the motor with a space through which air passes for discharging.

* * * * *